US012203149B2

(12) United States Patent
Tada

(10) Patent No.: US 12,203,149 B2
(45) Date of Patent: Jan. 21, 2025

(54) STEEL FOR BOLTS, AND METHOD OF MANUFACTURING SAME

(71) Applicant: JFE STEEL CORPORATION, Tokyo (JP)

(72) Inventor: Masafumi Tada, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 753 days.

(21) Appl. No.: 17/284,787

(22) PCT Filed: Jun. 25, 2019

(86) PCT No.: PCT/JP2019/025093
§ 371 (c)(1),
(2) Date: Apr. 13, 2021

(87) PCT Pub. No.: WO2020/090149
PCT Pub. Date: May 7, 2020

(65) Prior Publication Data

US 2021/0404030 A1 Dec. 30, 2021

(30) Foreign Application Priority Data

Oct. 30, 2018 (JP) ..... JP2018-204051

(51) Int. Cl.

| | |
|---|---|
| ***C21D 9/00*** | (2006.01) |
| ***C21D 6/00*** | (2006.01) |
| ***C21D 8/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C21D 9/0081* (2013.01); *C21D 6/004* (2013.01); *C21D 6/005* (2013.01); *C21D 6/008* (2013.01); *C21D 8/005* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/48* (2013.01); *C22C 38/50* (2013.01); *C22C 38/54* (2013.01); *C21D 2211/002* (2013.01)

(58) Field of Classification Search
CPC ..... C21D 9/0081; C21D 9/525
See application file for complete search history.

(56) References Cited

U.S. PATENT DOCUMENTS

| | | | | |
|---|---|---|---|---|
| 5,554,233 | A | 9/1996 | Heitmann et al. | |
| 6,547,890 | B2 | 4/2003 | Kanisawa et al. | |
| 9,845,519 | B2 | 12/2017 | Matsumoto et al. | |
| 10,457,998 | B2 | 10/2019 | Okonogi et al. | |
| 2008/0264524 | A1 | 10/2008 | Maruta et al. | |
| 2018/0016658 | A1* | 1/2018 | Okonogi ..... | C21D 6/002 |

FOREIGN PATENT DOCUMENTS

| | | | |
|---|---|---|---|
| CN | 101243197 | A | 8/2008 |
| CN | 101935806 | A | 1/2011 |
| CN | 104046903 | A | 9/2014 |
| CN | 104204254 | A | 12/2014 |
| JP | S61284554 | A | 12/1986 |
| JP | S62280326 | A | 12/1987 |
| JP | H02166229 | A | 6/1990 |
| JP | H09291312 | A | 11/1997 |
| JP | H10183238 | A | 7/1998 |
| JP | H10280036 | A | 10/1998 |
| JP | H11124623 | A | 5/1999 |
| JP | 2000336457 | A | 12/2000 |
| JP | 2006274373 | A | 10/2006 |

(Continued)

OTHER PUBLICATIONS

Oct. 19, 2022, Office Action issued by the Korean Intellectual Property Office in the corresponding Korean Patent Application No. 10-2021-7010818 with English language concise statement of relevance.

Apr. 5, 2023, Office Action issued by the Korean Intellectual Property Office in the corresponding Korean Patent Application No. 10-2021-7010818 with English language concise statement of relevance.

Dec. 9, 2021, Office Action issued by the China National Intellectual Property Administration in the corresponding Chinese Patent Application No. 201980071341.9 with English language search report.

Cao Jie et al., Continuous Cooling Transformation of Deformed Austenite of Non-quenched and Tempered Bainite Steel, Hot Working Technology, Jun. 2012, pp. 7-9, vol. 41, No. 12.

(Continued)

*Primary Examiner* — Christopher S Kessler
(74) *Attorney, Agent, or Firm* — KENJA IP LAW PC

(57) ABSTRACT

Disclosed is a non-heat-treated steel that has low deformation resistance during cold forging in bolt head forming and excellent product yield, and that can be manufactured without the need to perform heat treatment for controlling strength variation. The disclosed steel has a chemical composition containing C: 0.18-0.24%, Si: 0.10-0.22%, Mn: 0.60-1.00%, Al: 0.010-0.050%, Cr: 0.65-0.95%, Ti: 0.010-0.050%, B: 0.0015-0.0050%, N: 0.0050-0.0100%, P: 0.025% or less inclusive of 0, S: 0.025% or less inclusive of 0, Cu: 0.20% or less inclusive of 0, and Ni: 0.30% or less inclusive of 0, in a range satisfying: $0.45 \leq C+Si/24+Mn/6+Ni/40+Cr/5 \leq 0.60$ and $N \leq 0.519Al+0.292Ti$, with the balance being Fe and inevitable impurities; and a microstructure in which bainite is present in an area ratio of 95% or more, where the microstructure contains prior austenite grains with a grain size number of 6 or more, and strength variation is 100 MPa or less.

7 Claims, No Drawings

(56) References Cited

FOREIGN PATENT DOCUMENTS

| | | | |
|---|---|---|---|
| JP | 2015190002 | A | 11/2015 |
| KR | 1020000037996 | A | 7/2000 |
| WO | 2016121820 | A1 | 8/2016 |

OTHER PUBLICATIONS

Cao Jie et al., Experimental Production of Non-Quenched and Tempered Steel for Grade 10.9 Fasteners, Iron and Steel, Jan. 2012, pp. 65-68, vol. 47, No. 1.
Oct. 1, 2019, International Search Report issued in the International Patent Application No. PCT/JP2019/025093.

* cited by examiner

STEEL FOR BOLTS, AND METHOD OF MANUFACTURING SAME

TECHNICAL FIELD

This disclosure relates to steel for fastening parts that serve as fastening means such as bolts and screws, especially bolts with a strength classification of 8.8 or higher as specified in JIS B1051, and in particular to steel for so-called non-heat-treated bolts that can omit some thermal refining treatments in the manufacturing process of these parts, such as annealing, spheroidizing annealing, quenching, and tempering. Hereinbelow, steel used for fastening parts in general is collectively referred to as steel for bolts.

BACKGROUND

In recent years, with the increasing concern about environmental destruction and the rising price of petroleum resources, there has been a need to simplify or eliminate the heat treatment process in the manufacture of fastening parts such as bolts and screws.

In steel for bolts with a strength classification of 8.8 or higher in JIS B1051, the standard that specifies the chemical composition and strength of bolts, it is necessary to make the material stronger. Since the cold workability of such materials deteriorates, it is necessary to anneal the materials to soften them before cold forging such as wiredrawing and head forming. From the viewpoint of eliminating such a step, JP2006-274373A (PTL 1) proposes a high-strength steel for screws with excellent cold workability. Although using the steel described in PTL 1 makes it possible to omit the softening and annealing steps, there is a need for further omission of the manufacturing steps.

In addition, some steels for so-called non-heat-treated bolts, which go further than the aforementioned provisions of the JIS standard and omit the quenching and tempering steps along with the softening and annealing steps, have been put to practical use. For example, JPS61-284554A (PTL 2) proposes a steel for non-heat-treated bolts with excellent toughness. The steel for bolts proposed in PTL 2 attempts to improve toughness (ductility) through refinement of ferrite-pearlite microstructure. However, there is a need for further improvements in toughness (ductility) to improve wire drawability and cold workability, especially in bolt head forming, but such steels have yet to become widely used in practice.

In contrast, the technology described in JPH2-166229A (PTL 3) improves toughness (ductility) by applying controlled cooling after hot rolling to obtain bainitic microstructure. However, the austenite crystal grains become coarsened during preheating for hot rolling, and even after reaching the cold working stage, cracking occurs from the grain boundaries of the coarsened crystal grains, resulting in poor yield.

Furthermore, JP2015-190002A (PTL 4) proposes a non-heat-treated steel for weld bolts. Using a steel with the microstructure defined in PTL 4, the deformation resistance in wiredrawing can be kept low. In the manufacturing process of bolts, not only the workability at the time of wiredrawing, but also the workability at the time of bolt head forming through cold forging is required, and the steel described in PTL 4 is also required to improve this type of workability.

Furthermore, JPH9-291312A (PTL 5) proposes a production method of a high-strength wire rod for non-heat-treated bolts. Using the manufacturing process set forth in PTL 5, it is possible to obtain a wire rod that exhibits high strength and excellent workability. However, the technology proposed in PTL 5 requires a wire rod to be annealed at 500° C. to 700° C. for strength homogenization after the wire rod has been rolled and cooled to near room temperature. The fact that the annealing treatment is essential means that this step is not omittable, which is undesirable because it diminishes the advantage of omitting the quenching and tempering treatments.

Furthermore, JPH10-280036A (PTL 6) proposes a wire rod for bolts with high strength and ductility and its manufacturing method. Using the steel set forth in PTL 6, a steel wire with a tensile strength of 980 N/mm$^2$ or higher, corresponding to the 10T class or higher in the strength category of bolts, can be obtained by cold wiredrawing with a reduction ratio of 10% to 30%. However, it is currently difficult to manufacture bolts without thermal refining using steel with a strength of 10T class (10.9 class) or higher in the facilities of most bolt manufacturers. Therefore, there is a need to provide steel wires for non-heat-treated bolts with a strength of 8.8 class, which is lower than 10T class. This is because, in general, the lower the strength of the material, the better the workability. However, in a ferrite-pearlite microstructure, for example, the hardness difference between the ferrite and pearlite portions is large, and cracking is likely to occur at the boundaries between these portions, although the working load can be reduced. This is also true when the pearlite portion is replaced by a bainite portion. In other words, in the case of wire rods for non-heat-treated bolts in a strength class of 8.8, it is difficult to keep the strength of the wire rods low and at the same time maintain the bainite single phase, as compared to those for 10T. Thus, even with the use of bainite, the low strength of these wire rods causes problems with strength variation and cracking during bolt working, making the production of these wire rods more difficult than those for 10T.

CITATION LIST

Patent Literature

PTL 1: JP2006-274373A
PTL 2: JPS61-284554A
PTL 3: JPH2-166229A
PTL 4: JP2015-190002A
PTL 5: JPH9-291312A
PTL 6: JPH10-280036A

SUMMARY

Technical Problem

It would thus be helpful to provide a steel for bolts that has low deformation resistance during cold forging in bolt head forming, for example, and excellent product yield, even without thermal refining, i.e., even if it is non-heat-treated, and a method of manufacturing the same.

Solution to Problem

The present inventors conducted intensive research to address the above issues in the steel for bolts used in the manufacture of bolts, and as a result came to the following findings.

(1) Refinement of prior austenite crystal grains is the most effective way to suppress cracking at prior austenite grain boundaries during cold forging.

(2) In order to reduce the deformation resistance during cold forging in bolt head forming, it is desirable to obtain a larger Bauschinger effect.

(3) The Bauschinger effect is larger in a bainitic microstructure than in a ferrite-pearlite microstructure.

(4) The finer the prior austenite crystal grains, the larger the Bauschinger effect. The finer the prior austenite crystal grains, the higher the critical compression ratio of the steel wire after subjection to wiredrawing.

(5) The bainitic microstructure has high strength as it is hot-rolled, and the reduction ratio in a wiredrawing process to obtain a steel wire with the target strength can be reduced and good drawability can be achieved after the wiredrawing process.

(6) Strength variation in wire rods does not increase unless other microstructures are mixed in with the main microstructure, bainite. In contrast, the variation becomes larger when ferrite and martensite are mixed in. The inclusion of these microstructures is not a problem if it is less than 5%.

The present disclosure is the result of a study of the steel properties for which the above findings were obtained from the viewpoint of microstructure and chemical composition. In other words, the present inventors first compared a ferrite-pearlite microstructure and a bainitic microstructure in terms of workability during cold forging in bolt head forming. As a result, a bainitic microstructure was found to be superior because it provides a larger Bauschinger effect. The mechanism was as follows.

First of all, the Bauschinger effect is a phenomenon that when a metal material that has been subjected to plastic deformation as a pre-deformation is subjected to stress in a direction opposite to that of the pre-deformation, the deformation stress at that time decreases significantly compared to when stress is applied in the same direction again. In the manufacturing process of bolts, this Bauschinger effect is obtained when the head is formed after wiredrawing. Specifically, wiredrawing, which is a tensile stress process, subjects the material to work hardening and increases its tensile strength, whereas deformation resistance during head forming, which is a compression process, does not increase until a certain level of wiredrawing, and may even decrease. This Bauschinger effect is obtained by pile-up between dislocations that grow in the steel during plastic deformation. Such dislocations grown during plastic deformation pile up near grain boundaries and become stuck. This pile-up of dislocations is hardly eliminated by simply excluding the load for plastic deformation, and is retained. This is the mechanism of work hardening, and the more pile-up dislocations there are, the greater the amount of work hardening. However, when stress in the same direction as the stress required for the pile-up is applied again, which causes the previous pile-up to pile up more dislocations, causing work hardening. On the other hand, when stress is applied in the reverse direction, the deformation will proceed even though the stress does not increase beyond the required stress, because the reverse stress has the effect of eliminating this pile-up. This is the Bauschinger effect. In order to obtain a larger Bauschinger effect, (i) a dislocation growth source should be present in the steel and (ii) there should be grain boundaries where dislocations are allowed to pile up.

First, for the item (i) above, a comparison is made between ferrite-pearlite and bainite microstructures. In the case of a ferrite-pearlite microstructure, each dislocation source is located at the boundary between pearlite and ferrite, i.e., the grain boundary itself, whereas in the case of a bainitic microstructure, cementite can be dislocation sources, and thus b ainite is superior in terms of the number of dislocation sources. Next, a comparison is made for the item (ii) above. In the case of a ferrite-pearlite microstructure, a large difference in grain hardness between ferrite and pearlite causes dislocations to grow exclusively within ferrite grains, resulting in dislocations piling up only on the ferrite side of grain boundaries. In contrast, in the case of bainite, bainite grains are in contact with each other across one grain boundary and there is no large difference in hardness, and thus dislocations originating from cementite can pile up on both sides of the grain boundary. This means that a bainitic microstructure has grain boundaries at which dislocations can pile up with twice the area of that of a ferrite-pearlite microstructure. Therefore, bainite is also advantageous from the viewpoint of the item (ii).

In the case of a ferrite-pearlite microstructure, grain boundaries at which dislocations can pile up are the grain boundaries where ferrite and pearlite come in contact, which can be clearly observed by optical microscope observation. On the other hand, in the case of bainite, it was difficult to clearly identify grain boundaries by optical microscopy. As a result of investigating the amount of Bauschinger effect obtained in steels with bainitic microstructure in which the grain size at prior austenite grain boundaries was changed by various heat treatments, it was found that the finer the prior austenite grains, the larger the Bauschinger effect. Therefore, the inventors concluded that in the case of bainite, crystal grain boundaries at which dislocations can pile up are prior austenite grain boundaries. Whether ferrite-pearlite or bainite, the microstructure obtained upon cooling during heat treatment is finer than austenite. In order to obtain a Bauschinger effect from this refinement, a ferrite-pearlite microstructure is more advantageous since it provides ferrite crystal grains that are finer than prior austenite grains. However, since the effects described in the items (i) and (ii) always outweigh the effect of the refinement of a ferrite-pearlite microstructure, bainite provides a larger Bauschinger effect.

Next, with regard to strength, if a comparison is made between steels having almost the same chemical composition but different microstructures, the strength of steels with a bainitic microstructure is higher than steels with a ferrite-pearlite microstructure. In the case of a non-heat-treated bolt, steel is drawn into a steel wire directly after hot rolling, and the strength of the steel wire after the wiredrawing becomes the strength of the resulting bolt. In other words, the strength of the bolt is the sum of the strength of the steel after hot rolling and the increase in strength due to work hardening during wiredrawing. Naturally, the higher the strength of the material, the more likely it is to obtain the target strength at a lower drawing rate, and in this respect, a bainitic microstructure is more advantageous as it produces a high-strength steel as hot-rolled. In addition, a bainitic microstructure can maintain good drawability even after wiredrawing. This is because when a ferritic microstructure is mixed in with the main microstructure, specifically when the ferrite fraction is as high as 5% or more, the strain caused by wiredrawing is concentrated in ferrite grains, resulting in embrittlement at grain boundaries of ferrite crystal grains and deterioration in drawability. From this perspective, it is advantageous to have as low a ferritic microstructure fraction as possible.

A bainitic microstructure is also more advantageous from the viewpoint of suppressing cracking during bolt head forming. In other words, in a ferrite-pearlite microstructure, plastic strain during forming is concentrated in the ferrite grains, which are softer than pearlite, and as a result, micro-cracks, which act as starting points for cracking, tend to occur at grain boundaries between ferrite and pearlite. In contrast, a bainitic microstructure is homogeneous in hardness throughout compared to a ferrite-pearlite microstructure, because micro-cracks are less likely to occur at bainite grain boundaries. Furthermore, the finer the prior austenite grain size is in the same bainitic microstructure, the less likely cracks occur. This is because when the steel has an austenitic microstructure, segregation of intergranular embrittlement elements such as P and S at austenite grain boundaries is inevitable during cooling after casting and hot rolling. The P and S segregated at austenite grain boundaries remain segregated at prior austenite grain boundaries even after the subsequent microstructural transformation to bainite. As prior austenite grain boundaries are refined, the concentration of P and S per unit grain boundary area decreases as the prior austenite grain boundary area increases, making the prior austenite grain boundaries less susceptible to cracking. This effect can be evaluated by measuring the critical compression ratio before bolt head forming for various materials with different prior austenite grain sizes.

In practice, however, it has been difficult to produce wire rods with a bainite single-phase microstructure by hot rolling that can achieve a tensile strength of the steel wire after wiredrawing corresponding to about 8.8 in the strength category of bolts. This is because bainite is an intermediate microstructure between ferrite-pearlite and martensite, and if the strength is too high or too low, non-bainitic microstructures, i.e., martensite and/or ferrite, will be mixed in, making it difficult to suppress strength variation. In order to suppress strength variation, it is essential to strictly control the chemical composition of the steel and the cooling rate of the wire rod after hot rolling.

The above findings led to the completion of the present disclosure. Specifically, primary features of the present disclosure are as follows. 1. A steel for bolts comprising: a chemical composition containing (consisting of), in mass %, C: 0.18% to 0.24%, Si: 0.10% to 0.22%, Mn: 0.60% to 1.00%, Al: 0.010% to 0.050%, Cr: 0.65% to 0.95%, Ti: 0.010% to 0.050%, B: 0.0015% to 0.0050%, N: 0.0050% to 0.0100%, P: 0.025% or less inclusive of 0, S: 0.025% or less inclusive of 0, Cu: 0.20% or less inclusive of 0, and Ni: 0.30% or less inclusive of 0, in a range satisfying the following formulas (1) and (2):

$$0.45 \leq C+Si/24+Mn/6+Ni/40+Cr/5 \leq 0.60 \quad (1), \text{ and}$$

$$N \leq 0.519Al+0.292Ti \quad (2),$$

where C, Si, Mn, Ni, Cr, N, Al, and Ti represent the contents in mass % of respective elements, with the balance being Fe and inevitable impurities; and a microstructure in which bainite is present in an area ratio of 95% or more, wherein the microstructure contains prior austenite grains with a grain size number of 6 or more, and strength variation is 100 MPa or less.

2. The steel for bolts according to the item 1, wherein the chemical composition further contains, in mass %, Nb: 0.050% or less.

3. The steel for bolts according to the item 1 or 2, wherein the chemical composition further contains, in mass %, Mo: 0.70% or less, and instead of the formula (1), the following formula (3) is satisfied:

$$0.45 \leq C+Si/24+Mn/6+Ni/40+Cr/5+Mo/4 \leq 0.60 \quad (3),$$

where C, Si, Mn, Ni, Cr, and Mo represent the contents in mass % of respective elements.

4. A method of manufacturing a steel for bolts, the method comprising: hot rolling a steel billet having the chemical composition as recited in the item 1, 2, or 3 to obtain a hot-rolled steel; finishing the hot rolling at a hot-rolling finish temperature of 800° C. to 950° C.; and then cooling the hot-rolled steel at a cooling rate of 2° C./s or higher and 12° C./s or lower in a temperature range from the hot-rolling finish temperature to 500° C.

Advantageous Effect

According to the present disclosure, it is possible to provide a steel for bolts with high product yield, even if non-heat-treated, that can suppress the occurrence of cracking during cold forging in bolt head forming due to low deformation resistance. In particular, it is possible to provide a steel for bolts that is suitable as a material for non-heat-treated bolts with a strength classification of about 8.8 as specified in JIS B1051, i.e., a strength level of 800 MPa to 1000 MPa.

DETAILED DESCRIPTION

The steel for non-heat-treated bolts disclosed herein will be specifically described below. First, the reasons for limitations on each component in the chemical composition will be explained. When components are expressed in "%", this refers to "mass %" unless otherwise specified. Also, percentages of each microstructure are area fractions unless otherwise noted.

C: 0.18% to 0.24%

Carbon (C) is a beneficial element that can dissolve or form carbides in steel and improve the strength of the steel. C also becomes cementite when the steel forms a bainitic microstructure, and is also a source of dislocation generation. C is also an element that significantly improves the quench hardenability of the steel. To obtain these effects, C needs to be contained in an amount of 0.18% or more, and preferably 0.20% or more. On the other hand, C is an element that increases the quench hardenability of steel, and if contained above 0.24%, it increases the quench hardenability of the steel to the extent that it causes martensitic transformation instead of bainitic transformation, making the steel unsuitable for non-heat-treated bolts. In other words, if the steel has a martensitic microstructure, the dislocation density is too high that it inhibits dislocation migration and reduces the room for pile-up, resulting in inability to obtain a sufficient Bauschinger effect. As a result, not only is a sufficient Bauschinger effect not achieved, but also the drawability of the steel wire after wiredrawing is significantly reduced, making it unsuitable for use in bolts. Therefore, the upper limit of C content is set at 0.24%, and preferably at 0.22% or less.

Si: 0.10% to 0.22%

Silicon (Si) is an important element that can dissolve in iron and increase the strength of steel, yet it also has the effect of significantly increasing deformation resistance. In addition, Si is an effective element for adjusting the quench hardenability of steel and widening the range of cooling rates at which bainite can be obtained with an appropriate amount of Si added. To obtain this effect, Si needs to be contained in an amount of 0.10% or more, and preferably 0.13% or more. On the other hand, Si is an element that accelerates work hardening when added unnecessarily, deformation resistance after wiredrawing becomes so large that it cancels out the Bauschinger effect of bainite. Therefore, the upper limit of Si content is set at 0.22%. It is more preferably 0.20% or less.

Mn: 0.60% to 1.00%

Manganese (Mn) is an element that promotes the formation of bainite during steel cooling. To obtain this effect, Mn needs to be contained in an amount of 0.60% or more, preferably 0.65% or more, and more preferably 0.70% or more. On the other hand, Mn is an element that increases the quench hardenability of steel, and if contained in excess, it increases the quench hardenability of the steel to the extent that it causes martensitic transformation, making the steel unsuitable for use in non-heat-treated bolts. Therefore, the upper limit of Mn content is set at 1.00%. It is preferably 0.95% or less, and more preferably 0.90% or less.

Al: 0.010% to 0.050%

Aluminum (Al) combines with nitrogen (N) at or below about 1000° C. to form a precipitate as MN (aluminum nitride), which suppresses the coarsening of austenite crystal grains during heating for hot rolling. Al also has the effect of deoxidizing the steel. In other words, when the oxygen in the steel combines with C to form a gas, the amount of C in the steel decreases and the desired quench hardenability cannot be obtained. Therefore, it is necessary to deoxidize the steel with Al. To obtain these effects, Al needs to be contained in an amount of 0.010% or more. More preferably, it is 0.020% or more. On the other hand, if Al is present in excess, it will crystallize in large amounts as oxides that can cause nozzle clogging when combined with oxygen in the air during casting. Therefore, the upper limit of Al content is set at 0.050%. Preferably, it is 0.040% or less.

Cr: 0.65% to 0.95%

Chromium (Cr) is an element that improves the quench hardenability of steel and promotes bainitic transformation. To obtain this effect, Cr needs to be contained in an amount of 0.65% or more. On the other hand, if Cr is contained in excess above 0.95%, it increases the quench hardenability of the steel to the extent that it causes martensitic transformation, making the steel unsuitable for use in non-heat-treated bolts. Therefore, the upper limit of Cr content is set at 0.95%. More preferably, it is 0.70% or more and 0.90% or less.

Ti: 0.010% to 0.050%

Titanium (Ti) is an element that combines with N (nitrogen) to form a precipitate as a nitride, complementing the above-mentioned function of Al. Therefore, the Ti content is 0.010% or more. On the other hand, if the content exceeds 0.050%, Ti, like Al, will crystallize in large amounts as oxides that can cause nozzle clogging and so on when combined with oxygen in the air during casting. Therefore, the upper limit of Ti content is set at 0.050%. Preferably, it is 0.015% to 0.045%.

B: 0.0015% to 0.0050%

Boron (B) is an element that increases the quench hardenability of steel and promotes bainitic transformation. To obtain this effect, B needs to be contained in an amount of 0.0015% or more. On the other hand, if the content exceeds 0.0050%, the quench hardenability becomes too high and the steel inevitably has a martensitic microstructure. Therefore, the upper limit is set at 0.0050%. Preferably, it is 0.0018% or more and 0.0040% or less.

N: 0.0050% to 0.0100%

Nitrogen (N) combines with Al to form a precipitate as AlN, which suppresses the coarsening of austenite crystal grains during heating for hot rolling. To obtain this effect, the N content is 0.0050% or more. It is preferably 0.0055% or more. On the other hand, if N is present in excess in steel, it will turn into solute nitrogen to immobilize dislocations even after hot rolling, thus reducing the Bauschinger effect. Therefore, the upper limit of N content is set at 0.0100%. Preferably, it is 0.0090% or less.

As mentioned above, since the presence of N in the steel as solute nitrogen, even in small amounts, has the effect of reducing the Bauschinger effect, it is necessary to ensure that N is caused to precipitate before the end of hot rolling. To achieve this, the N content should be within the above range, and furthermore, the total content of Al and Ti, which form precipitates with N, should be greater than the N content in moles. Therefore, the following formula (2) should be satisfied:

$$N \leq 0.519Al + 0.292Ti \quad (2),$$

where N, Al, and Ti represent the contents in mass % of respective elements.

The balance of the chemical composition containing the above elements includes Fe and inevitable impurities. Preferably, the balance consists of Fe and inevitable impurities. As the chemical components detected as inevitable impurities, the contents of phosphorus (P), sulfur (S), copper (Cu), and nickel (Ni) should be suppressed within the following ranges.

P: 0.025% or less inclusive of 0

S: 0.025% or less inclusive of 0

P and S are impurities derived from raw materials, and although efforts have been made to reduce them in the steel refining process, it is not industrially realistic to reduce their contents completely to zero. Both P and S have the effect of embrittling the steel, yet they are not harmful to the actual use of the bolts if their contents are kept as low as 0.025% or below.

Cu: 0.20% or less inclusive of 0

Ni: 0.30% or less inclusive of 0

Cu and Ni are impurities that are inevitably contained in the raw material when the raw material is scrap metal. If Cu is contained in the steel in excess of 0.20%, the grain boundaries on the surface of the steel become embrittled during hot rolling, causing surface defects. Therefore, it is preferable to keep the Cu content at or below 0.20%. On the other hand, Ni is an element that increases the quench hardenability of steel, and thus its concentration should be kept at or below 0.30% to avoid the formation of a martensitic microstructure. Inevitable impurities other than those mentioned above can be considered as not being added if the amount is kept below the lower limit of the analysis capability of the component analyzer.

Furthermore, the chemical composition should satisfy:

$$0.45 \leq C + Si/24 + Mn/6 + Ni/40 + Cr/5 \leq 0.60 \quad (1),$$

where C, Si, Mn, Ni, and Cr represent the contents in mass % of respective elements.

In other words, in order to obtain a sufficient Bauschinger effect, the microstructure should be composed of bainite single-phase as much as possible, and the formation of a ferritic microstructure should be suppressed. This is because in the presence of a ferritic microstructure, pile-up of dislocations is concentrated in ferrite crystal grains. Therefore, the formula (1), which specifies the right balance between the components to achieve both of the above two points, needs to yield a value of 0.45 or more. The formula (1) preferably yields a value of 0.47 or more, more preferably 0.49 or more, and most preferably 0.50 or more. Note that when Ni is not contained, the value of Ni content in the formula (1) is considered to be 0 (zero).

The formula (1) is useful not only from the viewpoint of Bauschinger effect but also from the viewpoint of strength variation. That is, if the formula (1) yields a value equal to or higher than the lower limit, the microstructure becomes substantially bainite-single phase, making it possible to prevent the formation of excessively low strength portions in a part of the wire rod due to the inclusion of ferrite in the microstructure. In contrast, if martensite is mixed in with the bainite single-phase microstructure, there is a concern that excessively high strength portions may be formed. To avoid this, the formula (1), which specifies the right balance between the components, needs to yield a value of 0.60 or less. The upper limit in the formula (1) is preferably 0.59 or less, more preferably 0.58 or less, and most preferably 0.57 or less.

Optionally, the above chemical composition may further contain Nb to ensure proper quench hardenability.

Nb: 0.050% or Less

Niobium (Nb) is an element that combines with nitrogen to form a precipitate as a nitride, complementing the function of Al. In other words, in order to ensure quench hardenability by adding Nb, Nb is preferably added in an amount of 0.005% or more. On the other hand, if Nb is added in excess beyond 0.050%, nitrides will preferentially precipitate at grain boundaries of the steel, lowering the strength at the grain boundaries and causing intergranular cracking, which will leave surface cracks after casting. Therefore, the Nb content is 0.050% or less, and more preferably 0.040% or less.

Optionally, the above chemical composition may further contain Mo.

Mo: 0.70% or Less

Molybdenum (Mo) is an element that suppresses the segregation of intergranular embrittlement elements such as P and S at austenite grain boundaries during heating, and reduces the risk of cracking occurring at prior austenite grain boundaries when dislocations are piled up. To this end, Mo is preferably added in an amount of 0.05% or more. On the other hand, Mo also has the effect of increasing the quench hardenability of steel, and if added in excess, the microstructure of the steel will be martensitic instead of bainitic. Therefore, the upper limit of Mo content is preferably set at 0.70%. It is more preferably 0.60% or less.

When Mo is added, for the same reason as in the formula (1), the following formula (3) should be satisfied:

$$0.45 \leq C+Si/24+Mn/6+Ni/40+Cr/5+Mo/4 \leq 0.60 \quad (3),$$

where C, Si, Mn, Ni, Cr, and Mo represent the contents in mass % of respective elements.

Next, it is important for the steel for bolts to have a microstructure in which bainite is present in an amount of 95% or more and that contains prior austenite grains with a grain size number of 6 or more.

Bainite: 95% or More

In order to obtain a sufficient Bauschinger effect in bolt head forming after wiredrawing, the microstructure should be composed of bainite single-phase as much as possible, as described above. From the viewpoint of suppressing strength variation, it is also preferable that the microstructure be as close to a bainite single-phase microstructure as possible. In view of the above, bainite should be present in an area ratio of at least 95% or more. The area ratio is preferably 97.5% or more, and more preferably 99% or more. Of course, it may be 100%.

The microstructure proportions of bainite and ferrite both mean the area ratios on the surface where the microstructure observation is conducted.

Grain Size Number of Prior Austenite Grains: 6 or More

Since a prior austenite grain boundary is the place where dislocations pile up when the microstructure is a bainitic microstructure, dislocations will not pile up sufficiently unless a grain size of 6 or more in terms of grain size number specified in JIS G0551 is ensured, resulting in inability to obtain a sufficient Bauschinger effect. Preferably, the grain size is 7 or more.

Strength Variation: 100 MPa or Less

Unlike the steel for heat-treated bolts, the strength of the steel for non-heat-treated bolts after work hardening by wiredrawing is directly related to the strength of the resulting bolts, and thus the strength variation of the wire rod directly affects the strength variation of the final product, the bolt. In addition, large strength variation of wire rods has a pronounced effect on the incidence of defects in the products and manufacturing equipment during the manufacturing process following the production of the wire rods, i.e., wiredrawing and bolt head forming. Taking these factors into consideration, it is desirable to keep the strength variation within 100 MPa, and more preferably within 80 MPa, in the actual manufacturing of bolts.

As mentioned above, since steel for non-heat-treated bolts is usually used in the manufacture of bolts as wire rods, the strength variation in steel for non-heat-treated bolts is directly related to the strength variation of the wire rod. The strength variation of a wire rod refers to the strength variation within a single ring of a wire rod. In the case of products shipped in coils such as steel wire rods, a wire rod is often cooled in the form of a stretched coil by stacking multiple rings with their axial centers mutually displaced in the conveying direction using a laying head or the like during the conveying process for coiling the wire rod. In this case, depending on the degree of overlap between the rings, some parts of a ring cool faster than others, and uneven cooling occurs within the same ring. This causes strength variation within the ring, and it is customary to regard this strength variation within the ring as the strength variation of the entire coil. In fact, during the outgoing inspection of a coil, several to a dozen rings are truncated from both ends of the coil immediately after rolling as the unsteady part, and then a tensile test specimen is taken from an end of the remaining steady part as appropriate to investigate the strength variation.

Next, a method of manufacturing a steel for bolts will be described in detail.

It is important to finish hot rolling of a steel billet having the above chemical composition at a hot-rolling finish temperature of 800° C. to 950° C., and then cool them at a cooling rate of 2° C./s or higher and 12° C./s or lower in a temperature range from the hot-rolling finish temperature to 500° C. In order to maximize the Bauschinger effect, it is necessary to cause bainitic transformation while suppressing ferrite precipitation during cooling after hot rolling of the steel. When the hot-rolling finish temperature exceeds 950° C., it becomes industrially difficult to ensure a cooling rate of at least 2° C./s in a temperature range down to 500° C., and ferrite precipitation occurs. Even if ferrite precipitation could be suppressed, austenite grains would be coarsened, and prior austenite grains in the resulting microstructure would have a grain size number of less than 6. The hot-rolling finish temperature is more preferably 925° C. or lower.

On the other hand, when the hot-rolling finish temperature is lower than 800° C., recovery of dislocations introduced during the hot rolling and recrystallization are inhibited, and ferrite precipitation occurs using the dislocations as precipitation nuclei. Therefore, the hot-rolling finish temperature is 800° C. or higher. More preferably, it is 825° C. or higher. In order to cause bainitic transformation in a steel with the component proportions balanced as in the formula (1) or (3), it is necessary to cool the steel at a cooling rate of 2° C.//s or higher after hot rolling. It is preferably 3° C./s or higher, more preferably 4° C./s or higher, and most preferably 5° C./s or higher. On the other hand, if the cooling rate is too fast than 12° C./s, a martensitic microstructure will be formed. Therefore, the cooling rate is 12° C./s or lower. It is preferably 11° C./s or lower, and more preferably 10° C./s or lower.

The above steel for bolts after hot rolling is generally made as a coiled wire rod, and the roundness of the cross-sectional shape of the wire rod is low. In addition, the surface of the wire rod is covered with an oxide film formed during cooling after hot rolling. Thus, it is not desirable to use it as is for bolts. Therefore, after removing the oxide film from the above wire rod by pickling, the wire rod is drawn to make a steel wire for bolts with high roundness. The steel wire obtained by the wiredrawing process preferably has a critical compression ratio of 40% or more. As used herein, the critical compression ratio refers to a critical setting ratio determined by the cold setting test established by the Cold Forging Subcommittee of the Japan Society for Technology of Plasticity (see, "*Journal of Plasticity and Machining*", 1981, Vol. 22, No. 241, p. 139, published by the Material Research Group of Cold Forging Subcommittee).

Example 1

The present disclosure will be described below based on examples. However, it is not limited to the examples disclosed herein. Note that P, S, Cu, and Ni are the components derived from raw materials. P and S are impurities that are difficult to remove completely. Cu and Ni are concentrated in the steel at concentrations that are orders of magnitude higher when scrap is used as the raw material than when iron ore is used as the raw material. Accordingly, these components were intentionally added to each steel specimen to match the actual conditions.

Steel specimens with the chemical compositions listed in Table 1 were smelted in a vacuum melting furnace, and a 50 kg steel ingot was cast. In this case, Steel Nos. 52 and 56 were abandoned because a large amount of Si oxides, Al oxides, or Ti oxides were precipitated during casting, the hot ductility decreased, many cracks occurred in the ingot, and these specimens were unusable for subsequent rolling.

Each steel specimen thus obtained was heated to 1050° C. or higher and drawn to a wire rod of 16.0 mmϕ by applying hot rolling. At that time, the hot-rolling finish temperature was adjusted as listed in Table 2. Then, the wire rods after hot rolling were cooled at various cooling rates listed in Table 2 to build up microstructures presented in Table 2. A cylindrical specimen for measuring the deformation resistance was processed from each wire rod thus obtained. Each cylindrical specimen was sized 10 mmϕ×15 mm. The deformation resistance measurement method was as proposed by Osakada et al. in Ann. CIRP in 1981 based on the above-described cold setting test method. The stress at a strain of 0.50 in the stress-strain curve obtained in the compression test according to this method was used as the deformation resistance. The compression speed during the compression test was set at 5 mm/min.

The strength variation was also investigated in each wire rod after hot rolling. Each specimen was in the form of a coil of the corresponding wire rod after hot rolling as described above. After truncating 10 rings from both ends of the coil of each wire rod as the unsteady part, a wire rod of 3 m long was cut from an end of the remaining steady part. Then, each 3 m-long wire rod was further divided into 12 sections, each of which sections was used as a No. 2 test piece as specified in JIS Z2241 and examined for tensile strength. The reason why the length was set to 3 m is that since the inner diameter of the coil of each wire rod at the time of the investigation was 1 m, the present inventors multiplied the inner diameter by the circumference factor to obtain a ring equivalent to about 3 m, and decided to divide each 3 m-long wire rod into 12 sections. The speed of the tensile test was set at 10 mm/min. The strength of each wire rod is the maximum stress attained during the tensile test, and the strength variation is the difference between the specimen that showed the highest attained maximum stress and the lowest among the 12 specimens.

In addition, the above hot-rolled wire rods were drawn by cold wiredrawing into 12.7 mmϕ or, for some, 14.7 mmϕ (Sample No. 79 in Table 2) and 10.4 mmϕ (Sample No. 80) steel wires. Each steel wire obtained after the wiredrawing was processed into test pieces for measuring the deformation resistance and tensile test pieces in the same way as described above. The test specimens and test method for determining the deformation resistance were the same as above. The tensile test specimens were No. 2 test specimens as specified in JIS Z2241. The tensile speed was set at 10 mm/min. The strength of each steel wire was the maximum stress attained during the tensile test, and the drawability was determined by comparing the diameter of the fractured part of each specimen after application of tension with the diameter of the specimen before application of tension.

From each drawn steel wire, a grooved cylindrical specimen was also machined to measure the critical compression ratio. The specimen for measuring the critical compression ratio was a 10 mmϕ×15 mm cylindrical specimen with a single groove extending in the axial direction (opening angle: 30°±5°, depth: 0.8 mm±0.05 mm, radius of the groove bottom: 0.15 mm±0.05 mm) machined at an arbitrary position on its circumference. The test method for the critical compression ratio was also based on the method established by the Cold Forging Subcommittee of the Japan Society for Technology of Plasticity. The compression speed of the compression test to measure the critical compression ratio was also set to 5 mm/min. Note that in the actual manufacture of bolts in general, when the critical compression ratio of the steel wire is 40% or higher, the incidence of cracks during bolt head forming is reduced, which improves the process capability and leads to improved efficiency in spot-checking and inspection of the product, which in turn reduces the risk of outflow of defective products.

The test results are listed in Table 2.

Note that Comparative Examples of Sample Nos. 57 and 63 contained a large amount of Nb and Cu, respectively, beyond the amounts specified in this disclosure, which caused a large number of surface defects in the wire rods after hot rolling and made it impossible to practically perform wiredrawing. Thus, items including the prior austenite grain size are shown as blank.

The Bauschinger effect was evaluated as "good" when the deformation resistance of the steel wire after wiredrawing was not greater than the value obtained by multiplying the deformation resistance of the wire rod after hot rolling by 1.05, and as "poor" when the deformation resistance exceeded the value. As for the strength, if the strength of 800 MPa or more, which is required for bolts with a strength classification of 8.8 or higher, was obtained in the steel wire that had undergone the above process, the specimen passed the test, whereas if the strength was less than 800 MPa, the specimen failed the test. In addition, if a drawability of 52% or more, which is required for bolts with a strength classification of 8.8 or higher, was achieved, the specimen passed the test, whereas if the drawability was less than 52%, the specimen failed the test.

TABLE 1-1

| Steel sample No. | Chemical composition (mass %) C | Si | Mn | P | S | Cu | Ni | Cr | Al | Ti | (ppm by mass) B | N | (mass %) Mo | Nb | Formula (1)' or (3)' | Satisfy or not satisfy formula (2) | Remarks |
|---|---|---|---|---|---|---|---|---|---|---|---|---|---|---|---|---|---|
| 1 | 0.18 | 0.12 | 0.61 | 0.010 | 0.025 | 0.20 | 0.15 | 0.88 | 0.049 | 0.010 | 16 | 100 | — | — | 0.47 | satisfy | Example |
| 2 | 0.20 | 0.21 | 0.99 | 0.015 | 0.010 | 0.05 | 0.08 | 0.71 | 0.011 | 0.016 | 50 | 45 | — | — | 0.52 | satisfy | Example |
| 3 | 0.22 | 0.14 | 0.66 | 0.012 | 0.021 | 0.15 | 0.30 | 0.79 | 0.039 | 0.032 | 19 | 69 | — | — | 0.50 | satisfy | Example |
| 4 | 0.24 | 0.19 | 0.94 | 0.013 | 0.005 | 0.19 | 0.22 | 0.94 | 0.022 | 0.046 | 39 | 51 | — | — | 0.60 | satisfy | Example |
| 5 | 0.19 | 0.10 | 0.71 | 0.008 | 0.015 | 0.06 | 0.14 | 0.89 | 0.030 | 0.048 | 26 | 79 | — | — | 0.49 | satisfy | Example |
| 6 | 0.23 | 0.13 | 0.89 | 0.014 | 0.024 | 0.14 | 0.09 | 0.68 | 0.048 | 0.012 | 17 | 81 | — | — | 0.52 | satisfy | Example |
| 7 | 0.21 | 0.16 | 0.86 | 0.025 | 0.011 | 0.18 | 0.29 | 0.72 | 0.012 | 0.017 | 48 | 99 | — | — | 0.51 | satisfy | Example |
| 8 | 0.18 | 0.20 | 0.62 | 0.012 | 0.020 | 0.07 | 0.21 | 0.80 | 0.038 | 0.033 | 20 | 46 | — | — | 0.46 | satisfy | Example |
| 9 | 0.21 | 0.22 | 0.98 | 0.010 | 0.006 | 0.13 | 0.13 | 0.93 | 0.023 | 0.047 | 38 | 68 | — | — | 0.57 | satisfy | Example |
| 10 | 0.24 | 0.15 | 0.60 | 0.024 | 0.016 | 0.17 | 0.10 | 0.88 | 0.031 | 0.013 | 27 | 52 | — | — | 0.52 | satisfy | Example |
| 11 | 0.23 | 0.18 | 0.65 | 0.006 | 0.023 | 0.08 | 0.28 | 0.69 | 0.047 | 0.018 | 18 | 78 | — | — | 0.49 | satisfy | Example |
| 12 | 0.19 | 0.16 | 0.70 | 0.020 | 0.012 | 0.12 | 0.20 | 0.73 | 0.013 | 0.034 | 47 | 82 | — | — | 0.46 | satisfy | Example |
| 13 | 0.20 | 0.17 | 0.85 | 0.005 | 0.019 | 0.16 | 0.12 | 0.81 | 0.037 | 0.039 | 21 | 98 | — | — | 0.51 | satisfy | Example |
| 14 | 0.18 | 0.12 | 0.90 | 0.011 | 0.007 | 0.09 | 0.11 | 0.92 | 0.024 | 0.014 | 37 | 47 | — | — | 0.52 | satisfy | Example |
| 15 | 0.24 | 0.19 | 0.95 | 0.016 | 0.017 | 0.10 | 0.27 | 0.87 | 0.033 | 0.019 | 28 | 67 | — | — | 0.59 | satisfy | Example |
| 16 | 0.21 | 0.16 | 1.00 | 0.022 | 0.022 | 0.20 | 0.23 | 0.86 | 0.014 | 0.035 | 19 | 53 | — | — | 0.56 | satisfy | Example |
| 17 | 0.24 | 0.17 | 0.67 | 0.014 | 0.013 | 0.15 | 0.16 | 0.85 | 0.010 | 0.038 | 46 | 77 | — | — | 0.53 | satisfy | Example |
| 18 | 0.20 | 0.21 | 0.93 | 0.012 | 0.018 | 0.18 | 0.17 | 0.84 | 0.021 | 0.015 | 22 | 83 | — | — | 0.54 | satisfy | Example |
| 19 | 0.20 | 0.19 | 0.72 | 0.024 | 0.008 | 0.08 | 0.18 | 0.74 | 0.029 | 0.020 | 36 | 97 | — | — | 0.48 | satisfy | Example |
| 20 | 0.23 | 0.20 | 0.88 | 0.018 | 0.024 | 0.09 | 0.15 | 0.76 | 0.040 | 0.036 | 29 | 48 | — | — | 0.54 | satisfy | Example |
| 21 | 0.21 | 0.16 | 0.87 | 0.005 | 0.014 | 0.08 | 0.30 | 0.75 | 0.050 | 0.037 | 45 | 66 | — | — | 0.52 | satisfy | Example |
| 22 | 0.19 | 0.16 | 0.63 | 0.013 | 0.009 | 0.05 | 0.29 | 0.77 | 0.025 | 0.016 | 24 | 54 | — | — | 0.46 | satisfy | Example |
| 23 | 0.24 | 0.14 | 0.97 | 0.007 | 0.025 | 0.14 | 0.10 | 0.66 | 0.046 | 0.021 | 23 | 76 | — | — | 0.54 | satisfy | Example |
| 24 | 0.20 | 0.16 | 0.64 | 0.021 | 0.005 | 0.08 | 0.11 | 0.70 | 0.026 | 0.029 | 41 | 84 | — | — | 0.46 | satisfy | Example |
| 25 | 0.22 | 0.18 | 0.61 | 0.006 | 0.020 | 0.16 | 0.16 | 0.78 | 0.035 | 0.017 | 42 | 96 | — | — | 0.49 | satisfy | Example |
| 26 | 0.21 | 0.19 | 0.89 | 0.025 | 0.012 | 0.18 | 0.08 | 0.90 | 0.034 | 0.022 | 26 | 49 | — | — | 0.55 | satisfy | Example |
| 27 | 0.23 | 0.21 | 0.60 | 0.021 | 0.013 | 0.17 | 0.09 | 0.95 | 0.019 | 0.028 | 19 | 65 | — | — | 0.53 | satisfy | Example |
| 28 | 0.24 | 0.16 | 1.00 | 0.011 | 0.024 | 0.15 | 0.13 | 0.89 | 0.033 | 0.011 | 45 | 55 | — | — | 0.59 | satisfy | Example |
| 29 | 0.20 | 0.19 | 0.88 | 0.023 | 0.010 | 0.14 | 0.12 | 0.69 | 0.028 | 0.015 | 48 | 75 | — | — | 0.50 | satisfy | Example |
| 30 | 0.23 | 0.22 | 0.97 | 0.013 | 0.005 | 0.12 | 0.23 | 0.86 | 0.039 | 0.031 | 28 | 85 | — | — | 0.58 | satisfy | Example |
| 31 | 0.23 | 0.19 | 0.99 | 0.024 | 0.024 | 0.20 | 0.18 | 0.74 | 0.027 | 0.045 | 45 | 95 | — | — | 0.56 | satisfy | Example |
| 32 | 0.24 | 0.20 | 0.71 | 0.005 | 0.016 | 0.05 | 0.30 | 0.66 | 0.035 | 0.049 | 33 | 51 | — | — | 0.51 | satisfy | Example |
| 33 | 0.19 | 0.14 | 0.62 | 0.010 | 0.007 | 0.14 | 0.10 | 0.95 | 0.010 | 0.018 | 15 | 64 | — | — | 0.49 | satisfy | Example |
| 34 | 0.21 | 0.19 | 0.65 | 0.005 | 0.018 | 0.13 | 0.30 | 0.68 | 0.040 | 0.023 | 18 | 56 | — | — | 0.47 | satisfy | Example |
| 35 | 0.22 | 0.10 | 0.95 | 0.013 | 0.024 | 0.10 | 0.29 | 0.88 | 0.026 | 0.027 | 25 | 74 | — | — | 0.57 | satisfy | Example |
| 36 | 0.18 | 0.20 | 0.72 | 0.024 | 0.025 | 0.08 | 0.20 | 0.92 | 0.041 | 0.019 | 40 | 86 | — | — | 0.50 | satisfy | Example |
| 37 | 0.24 | 0.17 | 0.97 | 0.014 | 0.021 | 0.16 | 0.16 | 0.84 | 0.048 | 0.024 | 49 | 94 | — | — | 0.58 | satisfy | Example |
| 38 | 0.20 | 0.10 | 0.99 | 0.024 | 0.011 | 0.14 | 0.30 | 0.67 | 0.039 | 0.046 | 16 | 99 | — | 0.050 | 0.51 | satisfy | Example |
| 39 | 0.23 | 0.16 | 0.71 | 0.025 | 0.006 | 0.15 | 0.16 | 0.71 | 0.012 | 0.033 | 20 | 52 | — | 0.040 | 0.50 | satisfy | Example |
| 40 | 0.19 | 0.19 | 0.98 | 0.013 | 0.007 | 0.06 | 0.13 | 0.80 | 0.047 | 0.014 | 47 | 67 | — | 0.005 | 0.52 | satisfy | Example |
| 41 | 0.20 | 0.16 | 1.00 | 0.024 | 0.014 | 0.13 | 0.15 | 0.81 | 0.021 | 0.020 | 22 | 48 | — | 0.010 | 0.54 | satisfy | Example |
| 42 | 0.18 | 0.16 | 0.66 | 0.014 | 0.025 | 0.10 | 0.22 | 0.66 | 0.026 | 0.028 | 24 | 76 | 0.70 | — | 0.60 | satisfy | Example |
| 43 | 0.19 | 0.22 | 0.60 | 0.011 | 0.020 | 0.18 | 0.21 | 0.70 | 0.039 | 0.031 | 19 | 65 | 0.60 | — | 0.59 | satisfy | Example |
| 44 | 0.20 | 0.10 | 0.65 | 0.007 | 0.010 | 0.05 | 0.28 | 0.71 | 0.048 | 0.019 | 25 | 86 | 0.50 | — | 0.59 | satisfy | Example |
| 45 | 0.22 | 0.14 | 0.65 | 0.024 | 0.013 | 0.14 | 0.20 | 0.74 | 0.026 | 0.031 | 48 | 67 | — | — | 0.49 | satisfy | Example |

* For Mo-free steel, formula (1)': C + Si/24 + Mn/6 + Ni/40 + Cr/5, for Mo-containing steel, formula (3)': C + Si/24 + Mn/6 + Ni/40 + Cr/5 + Mo/4.

TABLE 1-2

| Steel sample No. | Chemical composition (mass %) C | Si | Mn | P | S | Cu | Ni | Cr | Al | Ti |
|---|---|---|---|---|---|---|---|---|---|---|
| 46 | 0.19 | 0.21 | 0.95 | 0.022 | 0.023 | 0.15 | 0.10 | 0.82 | 0.026 | 0.043 |
| 47 | 0.18 | 0.22 | 0.62 | 0.022 | 0.021 | 0.11 | 0.11 | 0.66 | 0.029 | 0.022 |
| 48 | 0.36 | 0.12 | 1.95 | 0.019 | 0.015 | 0.15 | 0.03 | 0.31 | 0.020 | 0.031 |
| 49 | 0.24 | 0.13 | 0.22 | 0.015 | 0.018 | 0.14 | 0.08 | 0.95 | 0.016 | 0.019 |
| 50 | 0.22 | 0.15 | 2.50 | 0.023 | 0.012 | 0.11 | 0.04 | 0.82 | 0.039 | 0.047 |
| 51 | 0.18 | 0.20 | 0.85 | 0.013 | 0.014 | 0.19 | 0.17 | 0.65 | 0.006 | 0.015 |
| 52 | 0.18 | 0.20 | 0.99 | 0.014 | 0.012 | 0.06 | 0.15 | 0.88 | 0.062 | 0.038 |
| 53 | 0.25 | 0.19 | 0.89 | 0.012 | 0.012 | 0.11 | 0.11 | 0.67 | 0.024 | 0.025 |
| 54 | 0.25 | 0.20 | 0.68 | 0.018 | 0.013 | 0.14 | 0.19 | 0.88 | 0.011 | 0.012 |
| 55 | 0.18 | 0.17 | 0.65 | 0.013 | 0.016 | 0.08 | 0.22 | 1.50 | 0.042 | 0.045 |
| 56 | 0.19 | 0.14 | 0.96 | 0.024 | 0.024 | 0.17 | 0.11 | 0.91 | 0.017 | 0.056 |
| 57 | 0.20 | 0.19 | 0.88 | 0.018 | 0.023 | 0.13 | 0.05 | 0.70 | 0.023 | 0.022 |
| 58 | 0.20 | 0.21 | 0.93 | 0.012 | 0.016 | 0.07 | 0.13 | 0.81 | 0.033 | 0.048 |
| 59 | 0.18 | 0.11 | 0.62 | 0.013 | 0.016 | 0.17 | 0.11 | 0.66 | 0.041 | 0.042 |
| 60 | 0.15 | 0.20 | 0.89 | 0.012 | 0.019 | 0.13 | 0.03 | 0.91 | 0.017 | 0.036 |
| 61 | 0.18 | 0.11 | 0.79 | 0.032 | 0.016 | 0.13 | 0.22 | 0.66 | 0.016 | 0.012 |
| 62 | 0.21 | 0.16 | 0.80 | 0.016 | 0.031 | 0.15 | 0.08 | 0.81 | 0.030 | 0.043 |
| 63 | 0.19 | 0.20 | 0.69 | 0.019 | 0.014 | 0.32 | 0.22 | 0.91 | 0.040 | 0.041 |
| 64 | 0.18 | 0.22 | 0.99 | 0.015 | 0.021 | 0.17 | 0.34 | 0.66 | 0.040 | 0.021 |
| 65 | 0.22 | 0.15 | 0.88 | 0.012 | 0.013 | 0.09 | 0.05 | 0.92 | 0.011 | 0.005 |
| 66 | 0.18 | 0.18 | 0.75 | 0.015 | 0.009 | 0.13 | 0.10 | 0.76 | 0.005 | 0.042 |
| 67 | 0.22 | 0.10 | 0.99 | 0.009 | 0.009 | 0.10 | 0.10 | 0.27 | 0.022 | 0.031 |
| 68 | 0.18 | 0.10 | 0.60 | 0.011 | 0.014 | 0.10 | 0.05 | 0.65 | 0.032 | 0.029 |
| 69 | 0.24 | 0.19 | 1.00 | 0.021 | 0.011 | 0.10 | 0.02 | 0.95 | 0.025 | 0.041 |
| 70 | 0.20 | 0.11 | 0.60 | 0.015 | 0.022 | 0.09 | 0.13 | 0.65 | 0.026 | 0.035 |
| 71 | 0.21 | 0.20 | 0.68 | 0.024 | 0.008 | 0.08 | 0.18 | 0.66 | 0.029 | 0.020 |
| 72 | 0.21 | 0.30 | 0.89 | 0.013 | 0.005 | 0.12 | 0.23 | 0.88 | 0.027 | 0.023 |
| 73 | 0.18 | 0.34 | 1.21 | 0.010 | 0.020 | 0.09 | 0.05 | 1.33 | 0.027 | 0.045 |
| 74 | 0.17 | 0.32 | 1.18 | 0.009 | 0.011 | 0.06 | 0.05 | 1.39 | 0.025 | 0.044 |

| Steel sample No. | Chemical composition (ppm by mass) B | N | (mass %) Mo | Nb | Formula (1)' or (3)' | Satisfy or not satisfy formula (2) | Remarks |
|---|---|---|---|---|---|---|---|
| 46 | 13 | 66 | — | — | 0.52 | satisfy | Comparative Example |
| 47 | 48 | 61 | — | — | 0.43 | satisfy | Comparative Example |
| 48 | 25 | 76 | — | — | 0.75 | satisfy | Comparative Example |
| 49 | 36 | 47 | — | — | 0.47 | satisfy | Comparative Example |
| 50 | 31 | 63 | — | — | 0.81 | satisfy | Comparative Example |
| 51 | 19 | 77 | — | — | 0.46 | not satisfy | Comparative Example |
| 52 | 22 | 46 | — | — | 0.53 | satisfy | Comparative Example |
| 53 | 27 | 122 | — | — | 0.54 | satisfy | Comparative Example |
| 54 | 24 | 97 | — | — | 0.55 | not satisfy | Comparative Example |
| 55 | 47 | 89 | — | — | 0.60 | satisfy | Comparative Example |
| 56 | 5 | 65 | — | — | 0.54 | satisfy | Comparative Example |
| 57 | 27 | 57 | — | 0.072 | 0.50 | satisfy | Comparative Example |
| 58 | 66 | 66 | — | — | 0.53 | satisfy | Comparative Example |
| 59 | 34 | 63 | 0.71 | — | 0.60 | satisfy | Comparative Example |
| 60 | 16 | 42 | — | — | 0.49 | satisfy | Comparative Example |
| 61 | 27 | 67 | — | — | 0.45 | satisfy | Comparative Example |
| 62 | 24 | 62 | — | — | 0.51 | satisfy | Comparative Example |
| 63 | 24 | 77 | — | — | 0.50 | satisfy | Comparative Example |
| 64 | 24 | 85 | — | — | 0.49 | satisfy | Comparative Example |
| 65 | 22 | 65 | — | — | 0.56 | satisfy | Comparative Example |
| 66 | 29 | 84 | — | — | 0.47 | satisfy | Comparative Example |
| 67 | 20 | 95 | — | — | 0.45 | satisfy | Comparative Example |
| 68 | 15 | 7 | — | — | 0.42 | satisfy | Comparative Example |
| 69 | 44 | 99 | — | — | 0.61 | satisfy | Comparative Example |
| 70 | 19 | 87 | 0.69 | — | 0.61 | satisfy | Comparative Example |
| 71 | 36 | 47 | — | — | 0.47 | satisfy | Comparative Example |
| 72 | 28 | 48 | — | — | 0.55 | satisfy | Comparative Example |
| 73 | 22 | 55 | — | — | 0.66 | satisfy | Comparative Example |
| 74 | 21 | 65 | — | 0.034 | 0.66 | satisfy | Comparative Example |

* For Mo-free steel, formula (1)': C + Si/24 + Mn/6 + Ni/40 + Cr/5, for Mo-containing steel, formula (3)': C + Si/24 + Mn/6 + Ni/40 + Cr/5 + Mo/4.

TABLE 2-1

| Sample No. | Steel sample No. | Hot rolling finish temperature (° C.) | Cooling rate | Bainite microstructure proportion (%) | Prior austenite grain size | Strength variation of wire rod (MPa) | (1) Deformation resistance of wire rod (MPa) | Area reduction rate of wire drawing (%) | (2) Deformation resistance of steel wire (MPa) |
|---|---|---|---|---|---|---|---|---|---|
| 1 | 1 | 907 | 5.1 | 96 | 7 | 89 | 968 | 37 | 999 |
| 2 | 2 | 863 | 5.0 | 100 | 8 | 55 | 970 | | 996 |
| 3 | 3 | 855 | 5.6 | 95 | 9 | 93 | 987 | | 976 |
| 4 | 4 | 814 | 3.7 | 96 | 9 | 84 | 992 | | 1011 |
| 5 | 5 | 895 | 10.8 | 100 | 7 | 52 | 970 | | 970 |
| 6 | 6 | 923 | 4.7 | 100 | 10 | 59 | 984 | | 978 |
| 7 | 7 | 911 | 5.7 | 99 | 6 | 65 | 971 | | 980 |
| 8 | 8 | 830 | 5.0 | 98 | 7 | 69 | 986 | | 1001 |
| 9 | 9 | 851 | 5.8 | 98 | 9 | 62 | 986 | | 976 |
| 10 | 10 | 862 | 6.3 | 100 | 11 | 60 | 974 | | 1008 |
| 11 | 11 | 827 | 4.0 | 100 | 9 | 51 | 969 | | 1008 |
| 12 | 12 | 815 | 5.2 | 96 | 7 | 92 | 969 | | 962 |
| 13 | 13 | 846 | 3.9 | 99 | 7 | 63 | 981 | | 988 |
| 14 | 14 | 836 | 4.2 | 95 | 9 | 99 | 968 | | 1004 |
| 15 | 15 | 886 | 3.5 | 96 | 7 | 82 | 972 | | 1012 |
| 16 | 16 | 845 | 5.9 | 100 | 6 | 55 | 970 | | 994 |
| 17 | 17 | 919 | 5.6 | 97 | 10 | 88 | 986 | | 986 |
| 18 | 18 | 940 | 3.6 | 100 | 7 | 57 | 961 | | 1011 |
| 19 | 19 | 820 | 5.0 | 96 | 6 | 87 | 977 | | 994 |
| 20 | 20 | 808 | 7.1 | 100 | 7 | 59 | 993 | | 980 |
| 21 | 21 | 907 | 11.3 | 99 | 10 | 62 | 957 | | 994 |
| 22 | 22 | 875 | 3.7 | 99 | 8 | 64 | 975 | | 974 |
| 23 | 23 | 829 | 5.9 | 100 | 6 | 56 | 975 | | 1000 |
| 24 | 24 | 866 | 10.8 | 98 | 7 | 73 | 988 | 37 | 981 |
| 25 | 25 | 901 | 4.7 | 96 | 7 | 94 | 966 | | 1003 |
| 26 | 26 | 827 | 5.7 | 100 | 8 | 58 | 967 | | 1016 |
| 27 | 27 | 814 | 10.1 | 97 | 6 | 77 | 973 | | 1018 |
| 28 | 28 | 895 | 3.0 | 100 | 9 | 52 | 960 | | 991 |
| 29 | 29 | 845 | 6.3 | 95 | 10 | 98 | 999 | | 990 |
| 30 | 30 | 923 | 4.3 | 100 | 9 | 53 | 951 | | 996 |
| 31 | 31 | 899 | 5.2 | 98 | 9 | 71 | 968 | | 995 |
| 32 | 32 | 917 | 4.1 | 95 | 7 | 99 | 969 | | 980 |
| 33 | 33 | 830 | 3.9 | 100 | 7 | 54 | 978 | | 987 |
| 34 | 34 | 809 | 5.0 | 96 | 7 | 89 | 968 | | 1008 |
| 35 | 35 | 862 | 3.5 | 97 | 7 | 73 | 970 | | 965 |
| 36 | 36 | 836 | 5.9 | 97 | 9 | 79 | 973 | | 1000 |
| 37 | 37 | 916 | 5.6 | 95 | 11 | 93 | 961 | | 978 |
| 38 | 38 | 808 | 3.6 | 97 | 11 | 76 | 984 | | 1031 |
| 39 | 39 | 835 | 5.3 | 96 | 7 | 81 | 987 | | 1020 |
| 40 | 40 | 836 | 8.8 | 100 | 7 | 59 | 978 | | 996 |
| 41 | 41 | 905 | 6.3 | 99 | 7 | 66 | 986 | | 1018 |
| 42 | 42 | 868 | 4.3 | 99 | 6 | 67 | 952 | | 980 |
| 43 | 43 | 829 | 10.1 | 100 | 10 | 58 | 962 | | 976 |
| 44 | 44 | 815 | 3.0 | 97 | 7 | 75 | 992 | | 991 |
| 45 | 45 | 836 | 3.6 | 96 | 10 | 83 | 970 | | 991 |
| 46 | 46 | 866 | 2.9 | 88 | 7 | 109 | 1021 | 37 | 1119 |
| 47 | 47 | 932 | 3.6 | 62 | 7 | 111 | 816 | | 911 |
| 48 | 48 | 847 | 6.2 | martensite | 10 | 95 | 1189 | | 1289 |
| 49 | 49 | 865 | 6.0 | 79 | 8 | 135 | 926 | | 1020 |
| 50 | 50 | 860 | 3.8 | martensite | 8 | 81 | 1141 | | 1279 |
| 51 | 51 | 920 | 4.7 | 99 | 4 | 63 | 961 | | 1059 |
| 52 | 52 | — | — | — | — | — | — | | — |
| 53 | 53 | 890 | 5.7 | 96 | 7 | 78 | 976 | | 1068 |
| 54 | 54 | 917 | 3.6 | 97 | 4 | 72 | 970 | | 1047 |
| 55 | 55 | 943 | 4.4 | martensite | 7 | 99 | 1220 | | 1309 |
| 56 | 56 | — | — | — | — | — | — | | — |
| 57 | 57 | 829 | 4.6 | many surface defects | — | — | — | | — |
| 58 | 58 | 893 | 3.4 | martensite | 9 | 83 | 1171 | | 1279 |
| 59 | 59 | 893 | 6.1 | martensite | 8 | 86 | 1222 | | 1322 |
| 60 | 60 | 875 | 7.7 | 72 | 8 | 129 | 926 | | 1020 |
| 61 | 61 | 874 | 5.3 | 99 | 7 | 71 | 967 | | 961 |
| 62 | 62 | 803 | 3.6 | 95 | 7 | 77 | 975 | | 979 |
| 63 | 63 | 851 | 4.6 | many surface defects | — | — | — | | — |
| 64 | 64 | 884 | 5.6 | martensite | 7 | 91 | 1199 | 37 | 1289 |
| 65 | 65 | 870 | 5.0 | 97 | 8 | 66 | 992 | | 1058 |
| 66 | 66 | 880 | 5.3 | 71 | 7 | 122 | 943 | | 1054 |
| 67 | 67 | 900 | 5.3 | 81 | 8 | 126 | 990 | | 1132 |
| 68 | 68 | 862 | 4.0 | 89 | 8 | 131 | 984 | | 1041 |
| 69 | 69 | 829 | 5.7 | 79 | 8 | 114 | 996 | | 1062 |

TABLE 2-1-continued

| | | | | | | | | | |
|---|---|---|---|---|---|---|---|---|---|
| 70 | 70 | 862 | 8.8 | 69 | 7 | 120 | 1002 | | 1069 |
| 71 | 71 | 888 | 4.7 | 99 | 4 | 63 | 961 | | 1059 |
| 72 | 72 | 903 | 8.8 | 97 | 9 | 77 | 1013 | | 1195 |
| 73 | 73 | 911 | 0.4 | 95 | 9 | 119 | 1222 | | 1356 |
| 74 | 74 | 888 | 0.6 | 97 | 9 | 113 | 1174 | | 1420 |
| 75 | 19 | 851 | 1.6 | 78 | 8 | 119 | 954 | | 1049 |
| 76 | 19 | 863 | 13.5 | martensite | 8 | 79 | 1208 | | 1313 |
| 77 | 19 | 977 | 2.7 | 90 | 5 | 107 | 962 | | 1082 |
| 78 | 19 | 779 | 11.0 | 72 | 9 | 133 | 951 | | 1044 |
| 79 | 19 | 845 | 10.8 | 100 | 7 | 73 | 992 | 16 | 993 |
| 80 | 19 | 874 | 5.7 | 97 | 7 | 69 | 954 | 58 | 994 |

| Sample No. | Steel sample No. | (2)/(1) | Evaluation of Bauschinger effect | Tensile strength after wire drawing (MPa) | Drawability (%) | Critical compression ratio (%) | Remarks |
|---|---|---|---|---|---|---|---|
| 1 | 1 | 1.03 | good | 872 | 77 | 62.0 | Example |
| 2 | 2 | 1.03 | good | 880 | 62 | 52.1 | Example |
| 3 | 3 | 0.99 | good | 871 | 54 | 55.9 | Example |
| 4 | 4 | 1.02 | good | 888 | 66 | 45.5 | Example |
| 5 | 5 | 1.00 | good | 945 | 72 | 58.5 | Example |
| 6 | 6 | 0.99 | good | 910 | 61 | 57.1 | Example |
| 7 | 7 | 1.01 | good | 912 | 69 | 54.4 | Example |
| 8 | 8 | 1.02 | good | 951 | 60 | 44.5 | Example |
| 9 | 9 | 0.99 | good | 913 | 55 | 48.3 | Example |
| 10 | 10 | 1.04 | good | 838 | 54 | 66.6 | Example |
| 11 | 11 | 1.04 | good | 947 | 61 | 48.9 | Example |
| 12 | 12 | 0.99 | good | 874 | 59 | 59.1 | Example |
| 13 | 13 | 1.01 | good | 896 | 72 | 56.3 | Example |
| 14 | 14 | 1.04 | good | 809 | 57 | 57.1 | Example |
| 15 | 15 | 1.04 | good | 890 | 74 | 58.8 | Example |
| 16 | 16 | 1.03 | good | 877 | 75 | 54.0 | Example |
| 17 | 17 | 1.00 | good | 926 | 64 | 59.5 | Example |
| 18 | 18 | 1.05 | good | 899 | 73 | 45.2 | Example |
| 19 | 19 | 1.02 | good | 922 | 54 | 49.2 | Example |
| 20 | 20 | 0.99 | good | 970 | 72 | 62.0 | Example |
| 21 | 21 | 1.04 | good | 879 | 57 | 57.2 | Example |
| 22 | 22 | 1.00 | good | 890 | 70 | 57.9 | Example |
| 23 | 23 | 1.03 | good | 846 | 63 | 54.0 | Example |
| 24 | 24 | 0.99 | good | 839 | 65 | 49.4 | Example |
| 25 | 25 | 1.04 | good | 974 | 59 | 59.1 | Example |
| 26 | 26 | 1.05 | good | 884 | 76 | 55.8 | Example |
| 27 | 27 | 1.05 | good | 806 | 54 | 66.3 | Example |
| 28 | 28 | 1.03 | good | 899 | 65 | 59.4 | Example |
| 29 | 29 | 0.99 | good | 928 | 72 | 52.1 | Example |
| 30 | 30 | 1.05 | good | 955 | 63 | 59.8 | Example |
| 31 | 31 | 1.03 | good | 866 | 77 | 58.5 | Example |
| 32 | 32 | 1.01 | good | 872 | 73 | 58.3 | Example |
| 33 | 33 | 1.01 | good | 880 | 66 | 63.2 | Example |
| 34 | 34 | 1.04 | good | 951 | 72 | 54.1 | Example |
| 35 | 35 | 1.00 | good | 869 | 61 | 48.3 | Example |
| 36 | 36 | 1.03 | good | 888 | 62 | 63.3 | Example |
| 37 | 37 | 1.02 | good | 945 | 60 | 45.0 | Example |
| 38 | 38 | 1.05 | good | 910 | 54 | 47.6 | Example |
| 39 | 39 | 1.03 | good | 829 | 76 | 60.1 | Example |
| 40 | 40 | 1.02 | good | 912 | 66 | 55.9 | Example |
| 41 | 41 | 1.03 | good | 806 | 65 | 52.7 | Example |
| 42 | 42 | 1.03 | good | 899 | 72 | 57.4 | Example |
| 43 | 43 | 1.01 | good | 928 | 60 | 62.5 | Example |
| 44 | 44 | 1.00 | good | 890 | 56 | 57.2 | Example |
| 45 | 45 | 1.02 | good | 880 | 76 | 55.9 | Example |
| 46 | 46 | 1.10 | poor | 913 | 51 | 38.4 | Comparative Example |
| 47 | 47 | 1.12 | poor | 805 | 77 | 39.2 | Comparative Example |
| 48 | 48 | 1.08 | poor | 1005 | 50 | 39.1 | Comparative Example |
| 49 | 49 | 1.10 | poor | 888 | 74 | 37.7 | Comparative Example |
| 50 | 50 | 1.12 | poor | 1013 | 51 | 37.6 | Comparative Example |
| 51 | 51 | 1.10 | poor | 846 | 66 | 37.3 | Comparative Example |
| 52 | 52 | — | — | — | — | — | Comparative Example |
| 53 | 53 | 1.09 | poor | 905 | 62 | 55.1 | Comparative Example |
| 54 | 54 | 1.08 | poor | 879 | 63 | 39.1 | Comparative Example |
| 55 | 55 | 1.07 | poor | 1103 | 49 | 19.1 | Comparative Example |
| 56 | 56 | — | — | — | — | — | Comparative Example |
| 57 | 57 | — | — | — | — | — | Comparative Example |
| 58 | 58 | 1.09 | poor | 999 | 44 | 30.9 | Comparative Example |
| 59 | 59 | 1.08 | poor | 1048 | 49 | 30.8 | Comparative Example |
| 60 | 60 | 1.10 | poor | 864 | 60 | 37.7 | Comparative Example |
| 61 | 61 | 0.99 | good | 870 | 49 | 34.4 | Comparative Example |
| 62 | 62 | 1.00 | good | 900 | 47 | 38.9 | Comparative Example |

TABLE 2-1-continued

| | | | | | | | |
|---|---|---|---|---|---|---|---|
| 63 | 63 | — | — | — | — | — | Comparative Example |
| 64 | 64 | 1.08 | poor | 1029 | 48 | 34.6 | Comparative Example |
| 65 | 65 | 1.07 | poor | 984 | 48 | 38.0 | Comparative Example |
| 66 | 66 | 1.12 | poor | 892 | 53 | 37.6 | Comparative Example |
| 67 | 67 | 1.14 | poor | 973 | 55 | 38.7 | Comparative Example |
| 68 | 68 | 1.06 | poor | 763 | 71 | 34.6 | Comparative Example |
| 69 | 69 | 1.07 | poor | 1159 | 48 | 39.1 | Comparative Example |
| 70 | 70 | 1.07 | poor | 1087 | 48 | 32.2 | Comparative Example |
| 71 | 71 | 1.10 | poor | 846 | 66 | 37.7 | Comparative Example |
| 72 | 72 | 1.18 | poor | 975 | 53 | 44.5 | Comparative Example |
| 73 | 73 | 1.11 | poor | 1203 | 44 | 33.3 | Comparative Example |
| 74 | 74 | 1.21 | poor | 1166 | 39 | 29.8 | Comparative Example |
| 75 | 19 | 1.10 | poor | 816 | 59 | 38.3 | Comparative Example |
| 76 | 19 | 1.09 | poor | 1041 | 38 | 32.2 | Comparative Example |
| 77 | 19 | 1.12 | poor | 849 | 62 | 37.6 | Comparative Example |
| 78 | 19 | 1.10 | poor | 806 | 70 | 39.1 | Comparative Example |
| 79 | 19 | 1.00 | good | 801 | 74 | 59.1 | Example |
| 80 | 19 | 1.04 | good | 948 | 55 | 43.2 | Example |

In Tables 1 and 2, sample Nos. 1 to 45 are our examples having steel components within the scope of the present disclosure.

In a comparative example of sample No. 46, the B content was less than the lower limit of the present disclosure and sufficient quench hardenability could not be obtained, and the fraction of bainite microstructure was less than the lower limit of the present disclosure, and instead the fraction of ferrite was increased, resulting in low-strength parts being mixed in, and the strength variation exceeded 100 MPa. In addition, the Bauschinger effect and critical compression ratio were insufficient.

In contrast, sample No. 47 is a comparative example in which the alloy composition range was within the specified range of the present disclosure, but the value yielded in the formula (1) was less than 0.45 and ferrite was mixed in with the bainite microstructure, resulting in large strength variation and an insufficient Bauschinger effect. Since the ferrite fraction was high in this comparative steel, the drawability was in the acceptable range.

Comparative examples of sample Nos. 48, 50, 55, 58, 59, and 64 were not only unable to obtain a sufficient Bauschinger effect because the microstructure became martensite single phase, but also the drawability was not more than 52%, making the steel unsuitable for use in bolts.

Sample No. 49 is a comparative example in which the Mn content was less than the lower limit of the present disclosure and the fraction of bainite microstructure was less than the lower limit of the present disclosure, resulting in large strength variation, an insufficient Bauschinger effect, and a low critical compression ratio. Since the ferrite fraction was high in this comparative steel, the drawability was in the acceptable range.

In a comparative example of sample No. 51, the Al content was outside the range of the present disclosure and did not satisfy the formula (2), resulting in coarsening of prior austenite crystal grains and inability to obtain a sufficient Bauschinger effect.

In the comparative example of Sample No. 53, the N content exceeded the upper limit of the present disclosure, and thus the strain aging did not produce a sufficient Bauschinger effect.

In a comparative example of sample No. 54, the content of each alloying component was within the specified range of the present disclosure, but the concentrations of Al and Ti did not satisfy the formula (2), resulting in coarsening of prior austenite crystal grains during heating of the steel prior to hot rolling and inability to obtain a sufficient Bauschinger effect.

Sample No. 60 is a comparative example in which the C content was less than the lower limit of the present disclosure and the fraction of bainite microstructure was less than the lower limit of the present disclosure, resulting in large strength variation, an insufficient Bauschinger effect, and a low critical compression ratio. Since the ferrite fraction was high in this sample No. 60, the drawability was in the acceptable range.

In a comparative example of sample No. 61, the P content exceeded 0.025%, resulting in embrittlement of the steel and inability to obtain a sufficiently high critical compression ratio after being drawn into a steel wire.

In a comparative example of sample No. 62, the S content exceeded 0.025%, resulting in embrittlement of the steel and inability to obtain a sufficiently high critical compression ratio after being drawn into a steel wire.

In a comparative example of sample No. 65, the toughness of the steel decreased due to insufficient addition of Ti, resulting in inability to obtain a sufficiently high drawability and critical compression ratio.

In a comparative example of sample No. 66, a sufficiently high quench hardenability and bainite fraction could not be obtained because the oxygen in the steel was combined with carbon due to the low Al content, resulting in inability to obtain a sufficient Bauschinger effect and critical compression ratio.

Sample No. 67 is a comparative example in which the Cr content was less than the lower limit of the present disclosure and a sufficient bainite microstructure could not be obtained, resulting in an insufficient Bauschinger effect and a low critical compression ratio. Since the ferrite fraction was high in this comparative steel, the drawability was in the acceptable range.

Sample No. 68 is a comparative example in which the content of each alloying component was within the specified range of the present disclosure, but the value yielded in the formula (1) was less than 0.45, resulting in large strength variation as a result of ferrite being mixed in with the bainite microstructure and an insufficient Bauschinger effect, for which the strength was judged as failed. Since the ferrite fraction was high in this comparative steel, the drawability was in the acceptable range.

Sample No. 69 is a comparative example in which the content of each alloying component was within the specified range of the present disclosure, but the value yielded in the formula (1) exceeded 0.60, resulting in large strength variation as a result of martensite being mixed in with the bainite microstructure and an insufficient Bauschinger effect, for which the strength was judged as failed.

Sample No. 70 is a comparative example in which the content of each alloying component was within the specified range of the present disclosure, but the value yielded in the formula (1) exceeded 0.60, resulting in large strength variation as a result of martensite being mixed in with the bainite microstructure and an insufficient Bauschinger effect, for which the strength was judged as failed.

In a comparative example of sample No. 71, the N content was less than the lower limit of the present disclosure, resulting in coarsening of prior austenite crystal grains and inability to obtain a sufficient Bauschinger effect.

In a comparative example of sample No. 72, the Si content was more than the upper limit of the present disclosure, resulting in a large amount of work hardening during wiredrawing and an insufficient Bauschinger effect.

A comparative example of sample No. 73 is a steel sample in which the Mn and Cr contents exceeded the specified ranges of the present disclosure and the left-hand side of the formula (1) exceeded the upper limit, as in sample Nos. 50 and 55. In order to obtain a bainite microstructure within the scope of the present disclosure, the cooling rate was intentionally lowered below the rate specified in the present disclosure. As a result, the microstructure itself became a bainite single phase, which was, however, a mixture of bainite microstructures with deviations in strength. Thus, the strength variation was outside the scope of the present disclosure, and the Bauschinger effect was not sufficient because of the excessive addition of alloys. In addition, the drawability and the critical compression ratio were low.

A comparative example of sample No. 74 is a steel sample in which the Mn and Cr contents exceeded the specified ranges of the present disclosure and the left-hand side of the formula (1) exceeded the upper limit, as in sample Nos. 50 and 55. In order to obtain a bainite microstructure within the scope of the present disclosure, the cooling rate was intentionally lowered below the rate specified in the present disclosure. As a result, the microstructure itself became a bainite single phase, which was, however, a mixture of bainite microstructures with deviations in strength. Thus, the strength variation was outside the scope of the present disclosure, and the Bauschinger effect was not sufficient because of the excessive addition of alloys. In addition, the drawability and the critical compression ratio were low.

A comparative example of sample No. 75 is a steel sample with the same composition as No. 19 in Table 1. However, since the cooling rate after hot rolling was lower than 2° C./s, a bainite-dominated microstructure could not be obtained, and since the microstructure proportion was outside the specified range of the present disclosure, a sufficient Bauschinger effect could not be obtained.

A comparative example of sample No. 76 is a steel sample with the same composition as No. 19 in Table 1. However, the cooling rate after hot rolling was higher than 12° C./s, resulting in a martensitic single-phase microstructure. As a result, not only was the Bauschinger effect insufficient, but also the drawability was not more than 52%, making the steel unsuitable for use in bolts.

A comparative example of sample No. 77 is a steel sample with the same composition as No. 19 in Table 1. However, since the hot-rolling finish temperature was higher than 950° C., ferrite was precipitated in excess of 5% and prior austenite grains were coarsened, resulting in an insufficient Bauschinger effect.

A comparative example of sample No. 78 is a steel sample with the same composition as No. 19 in Table 1. However, the hot-rolling finish temperature was lower than 800° C., resulting in a higher ferrite fraction and an insufficient Bauschinger effect.

Samples No. 79 and 80 are steel wires obtained by wiredrawing at an area reduction rate of 16% and 58%, respectively, from wire rods formed under the conditions according to the present disclosure in terms of the hot-rolling finish temperature and the subsequent cooling rate. Since the steel microstructure was a bainite single phase or had a bainite fraction of 95% or more and a ferrite fraction of less than 5%, a sufficient Bauschinger effect was achieved and good results were obtained for both drawability and critical compression ratio. Note that in a general manufacturing process of bolts, the area reduction rate for wiredrawing ranges from 15% to 60%.

The invention claimed is:

1. A steel for bolts comprising:

a chemical composition containing, in mass %,

C: 0.18% to 0.24%,

Si: 0.10% to 0.22%,

Mn: 0.60% to 1.00%,

Al: 0.010% to 0.050%,

Cr: 0.65% to 0.95%,

Ti: 0.010% to 0.050%,

B: 0.0015% to 0.0050%,

N: 0.0050% to 0.0100%,

P: 0.025% or less inclusive of 0,

S: 0.025% or less inclusive of 0,

Cu: 0.20% or less inclusive of 0, and

Ni: 0.30% or less inclusive of 0, in a range satisfying the following formulas (1) and (2):

$$0.45 \leq C+Si/24+Mn/6+Ni/40+Cr/5 \leq 0.60 \quad (1), \text{ and}$$

$$N \leq 0.519Al+0.292Ti \quad (2),$$

where C, Si, Mn, Ni, Cr, N, Al, and Ti represent the contents in mass % of respective elements, with the balance being Fe and inevitable impurities; and a microstructure in which bainite is present in an area ratio of 95% or more, wherein the microstructure contains prior austenite grains with a grain size number of 6 or more, and a strength variation is 100 MPa or less wherein the strength variation is a difference between a highest attained maximum stress and a lowest attained maximum stress showed during a tensile test among 12 specimens into which a 3 m-long wire rod cut from a steady part of a wire rod made of the steel is divided.

2. The steel for bolts according to claim 1, wherein the chemical composition further contains, in mass %, Nb: 0.050% or less.

3. A steel for bolts comprising: a chemical composition containing, in mass %, C: 0.18% to 0.24%, Si: 0.10% to 0.22%, Mn: 0.60% to 1.00%, Al: 0.010% to 0.050%, Cr: 0.65% to 0.95%, Ti: 0.010% to 0.050%, B: 0.0015% to 0.0050%, N: 0.0050% to 0.0100%, P: 0.025% or less inclusive of 0, S: 0.025% or less inclusive of 0, Cu: 0.20% or less inclusive of 0, Ni: 0.30% or less inclusive of 0, and Mo: 0.70% or less, and in a range satisfying the following formulas (3) and (2):

$$0.45 \leq C+Si/24+Mn/6+Ni/40+Cr/5+Mo/4 \leq 0.60 \quad (3), \text{ and}$$

$$N \leq 0.519Al+0.292Ti \quad (2),$$

where C, Si, Mn, Ni, Cr, Mo, N, Al, and Ti represent the contents in mass % of respective elements, with the balance being Fe and inevitable impurities; and a microstructure in which bainite is present in an area ratio of 95% or more, wherein the microstructure contains prior austenite grains with a grain size number of 6 or more, and a strength variation is 100 MPa or less wherein the strength variation is a difference between a highest attained maximum stress and a lowest attained maximum stress showed during a tensile test among 12 Specimens into which a 3 m-long wire rod cut from a steady part of a wire rod made of the steel is divided.

4. The steel for bolts according to claim 3, wherein the chemical composition further contains, in mass %, Nb: 0.050% or less.

5. A steel for bolts comprising:

a chemical composition consisting of, in mass %,

C: 0.18% to 0.24%,

Si: 0.10% to 0.22%,

Mn: 0.60% to 1.00%,

Al: 0.010% to 0.050%,

Cr: 0.65% to 0.95%,

Ti: 0.010% to 0.050%,

B: 0.0015% to 0.0050%,

N: 0.0045% to 0.0100%,

P: 0.025% or less inclusive of 0,

S: 0.025% or less inclusive of 0,

Cu: 0.20% or less inclusive of 0,

Ni: 0.30% or less inclusive of 0, and optionally, at least one selected from the group consisting of Nb: 0.050% or less and Mo: 0.70% or less, in a range satisfying the following formulas (1) and (2):

$$0.45 \leq C+Si/24+Mn/6+Ni/40+Cr/5 \leq 0.60 \quad (1), \text{ and}$$

$$N \leq 0.519Al+0.292Ti \quad (2),$$

with the proviso that the following formula (3) is satisfied instead of the formula (1) when Mo is contained, $$0.45 \leq C+Si/24+Mn/6+Ni/40+Cr/5+Mo/4 \leq 0.60 \quad (3),$$

where C, Si, Mn, Ni, Cr, N, Al, Ti, and Mo represent the contents in mass % of respective elements, with the balance being Fe and inevitable impurities; and a microstructure in which bainite is present in an area ratio of 95% or more, wherein the microstructure contains prior austenite grains with a grain size number of 6 or more, and a strength variation is 100 MPa or less wherein the strength variation is a difference between a highest attained maximum stress and a lowest attained maximum stress showed during a tensile test among 12 specimens into which a 3 m-long wire rod cut from a steady part of a wire rod made of the steel is divided.

6. The steel for bolts according to claim 5, wherein the content of Cr is 0.66% to 0.95%, the content of Ti is 0.010% to 0.49%, the content of P is 0.005% to 0.025%, the content of S is 0.005% to 0.025%, the content of Cu is 0.05% to 0.20%, the content of Ni is 0.08% to 0.30%, the content of Nb is 0.005% to 0.050%, Mo is not contained, and the value of the formula (1) is 0.46 to 0.60.

7. The steel for bolts according to claim 5, wherein the content of Cr is 0.66% to 0.95%, the content of Ti is 0.010% to 0.49%, the content of P is 0.005% to 0.025%, the content of S is 0.005% to 0.025%, the content of Cu is 0.05% to 0.20%, the content of Ni is 0.08% to 0.30%, the content of Nb is 0.005% to 0.050%, the content of Mo is 0.50% to 0.70%, and the value of the formula (3) is 0.59 to 0.60.

* * * * *